US010260487B2

(12) United States Patent
Yamazaki et al.

(10) Patent No.: US 10,260,487 B2
(45) Date of Patent: Apr. 16, 2019

(54) MPD THRUSTER THAT ACCELERATES ELECTRODELESS PLASMA AND ELECTRODELESS PLASMA ACCELERATING METHOD USING MPD THRUSTER

(71) Applicants: MITSUBISHI HEAVY INDUSTRIES, LTD., Tokyo (JP); National University Corporation Nagoya University, Aichi-ken (JP)

(72) Inventors: Takuya Yamazaki, Tokyo (JP); Hirofumi Shimizu, Tokyo (JP); Satoshi Fujiwara, Tokyo (JP); Akihiro Sasoh, Aichi (JP); Shigeru Yokota, Aichi (JP); Shota Harada, Aichi (JP); Teruaki Baba, Aichi (JP)

(73) Assignees: MITSUBISHI HEAVY INDUSTRIES, LTD., Tokyo (JP); NATIONAL UNIVERSITY CORPORATION NAGOYA UNIVERSITY, Aichi (JP)

( * ) Notice: Subject to any disclaimer, the term of this patent is extended or adjusted under 35 U.S.C. 154(b) by 18 days.

(21) Appl. No.: 15/313,746

(22) PCT Filed: Aug. 25, 2014

(86) PCT No.: PCT/JP2014/072147
§ 371 (c)(1),
(2) Date: Nov. 23, 2016

(87) PCT Pub. No.: WO2015/177942
PCT Pub. Date: Nov. 26, 2015

(65) Prior Publication Data

US 2017/0198683 A1 Jul. 13, 2017

(30) Foreign Application Priority Data

May 23, 2014 (JP) ..... 2014-107583

(51) Int. Cl.
*F03H 1/00* (2006.01)
*H05H 1/54* (2006.01)
(Continued)

(52) U.S. Cl.
CPC ..... *F03H 1/0081* (2013.01); *H01J 27/16* (2013.01); *H05H 1/46* (2013.01); *H05H 1/54* (2013.01); *H05H 2001/4667* (2013.01)

(58) Field of Classification Search
CPC ..... B64G 2/405; F03H 1/0012; F03H 1/0081; F03H 1/0087; H05H 1/54
See application file for complete search history.

(56) References Cited

U.S. PATENT DOCUMENTS 3,191,092 A 6/1965 Baker et al.
3,845,300 A * 10/1974 Roehling ..... B01D 59/44 250/282
(Continued)

FOREIGN PATENT DOCUMENTS

JP 5-45797 7/1993
JP 4925132 4/2012

OTHER PUBLICATIONS

Hoyt "Magnetic Nozzle Design for High-Power MPD Thrusters" 2005.*
(Continued)

*Primary Examiner* — William H Rodriguez
*Assistant Examiner* — William Breazeal
(74) *Attorney, Agent, or Firm* — Wenderoth, Lind & Ponack, L.L.P.

(57) ABSTRACT

Electrodeless plasma is supplied to a space between a cathode and an anode such that a resistivity in the space is reduced. The electrodeless plasma is accelerated with Lorentz force induced by a radial direction magnetic field
(Continued)

component and an axial direction magnetic field component that are generated in the space, and current in the space.

15 Claims, 10 Drawing Sheets

(51) Int. Cl.
*H01J 27/16* (2006.01)
*H05H 1/46* (2006.01)

(56) References Cited

U.S. PATENT DOCUMENTS

| | | | | |
|---|---|---|---|---|
| 4,866,929 | A * | 9/1989 | Knowles | B64G 1/405 60/202 |
| 5,357,747 | A | 10/1994 | Myers et al. | |
| 5,859,428 | A * | 1/1999 | Fruchtman | H05H 3/02 250/251 |
| 6,334,302 | B1 | 1/2002 | Chang-Diaz | |
| 7,400,096 | B1 | 7/2008 | Foster et al. | |
| 7,436,122 | B1 * | 10/2008 | Beal | F03H 1/0075 315/111.21 |
| 2006/0218891 | A1 | 10/2006 | Roy | |
| 2006/0290287 | A1 | 12/2006 | Kuninaka | |
| 2010/0213851 | A1 * | 8/2010 | Chang Diaz | F03H 1/0093 315/111.41 |

OTHER PUBLICATIONS

Cherkasova "Hollow Cathodes for 100κW MPD Thrusters" 2009.*
Fradkin Blackstock Roehling Stratton Williams and Liewer "Experiments Using a 25-kw Hollow Cathode Lithium Vapor MPD Arcjet" 1969, https://arc.aiaa.org/doi/pdf/10.2514/3.5783.*
International Preliminary Report on Patentability dated Nov. 24, 2016 in corresponding International Application No. PCT/JP2014/072147.
Written Opinion of the International Searching Authority dated Nov. 18, 2014 in corresponding International Application No. PCT/JP2014/072147 (with English translation).
Written Opinion of the International Preliminary Examining Authority dated Oct. 6, 2015 in corresponding International Application No. PCT/JP2014/072147 (with English translation).
International Search Report dated Nov. 18, 2014 in corresponding International Application No. PCT/JP2014/072147.
Ando, "The Challenge of High Power Plasma Thruster for Manned Space Exploration", Journal of Plasma and Fusion Research, Mar. 25, vol. 83, No. 3, pp. 276-280 (with machine translation).
Miyamoto et al., "Characterization of a helicon plasma thruster using multipole magnetic field", The Papers of Joint Technical Meeting on Plasma Science and technology and Pulsed Power Technology, IEE Japan PST-12-049-067, Aug. 8, 2012, pp. 63-67 (with machine translation).
Shinohara, "Development and Application of Helicon Plasma Sources—Expansion to the Wide Area Plasma Science", Physical Society of Japan, Jul. 5, 2009, vol. 64, No. 7, pp. 519-526 (with machine translation).
Suzuki et al., "Research and Development of High-Power Permanent-Magnet Applied-Field MPD Thrusters with Multi-Hollow Cathodes", 57th Space Science and Technology Federation Lecture Proceedings, Oct. 9, 2013, pp. 1-6 (with machine translation).
Miyazaki et al., "Experimental Study of high-power MPD thruster", FY2013 Space Plasma Research Group, Feb. 27, 2014, pp. 1-4 (with machine translation).
Kinoshita et al., "Experimental Study on ICRF Heating for a Plasma Propulsion System", The Japan Society of Plasma Science and Nuclear Fusion Research, Nov. 20, 2001, p. 44 (with machine translation).
Akihiro Sasoh et al., "Hall Acceleration in an Applied-Field MPD Thruster", vol. 37, No. 430, pp. 528-534, Magazine Japan Society for Aeronautical and Space Science, Nov. 1989 (with machine translation).
Hitoshi Kuninaka, "Hayabusa microwave discharge ion engine, which is mounted to the asteroid spacecraft", J. Plasma Fusion Res. vol. 82, No. 05, May 2006, pp. 300-304 (with machine translation).
Extended European Search Report dated Apr. 7, 2017 in corresponding European Application No. 14892356.8.
Toki et al., "Preliminary Investigation of Helicon Plasma Source for Electric Propulsion Applications", IEPC 03-0168, Feb. 15, 2003, XP055359793.
Cassady et al., "Recent advances in nuclear powered electric propulsion for space exploration", Energy Conversion and Management, vol. 49, No. 3, Dec. 2007, pp. 412-435, XP022436661.

* cited by examiner

MPD THRUSTER THAT ACCELERATES ELECTRODELESS PLASMA AND ELECTRODELESS PLASMA ACCELERATING METHOD USING MPD THRUSTER

CROSS-REFERENCE TO RELATED APPLICATION

The present application is based on and claims priority from Japanese Patent Application No. 2014-107583 filed on May 23, 2014. The disclosure thereof is incorporated herein by reference.

TECHNICAL FIELD

The present invention relates to an MPD thruster that accelerates electrodeless plasma and an electrodeless plasma accelerating method using an MPD thruster.

BACKGROUND ART

As a propulsion apparatus used in the space, an MPD thruster (Magneto-Plasma-Dynamic thruster) is known. FIG. 1 shows an example of the MPD thruster. The MPD thruster generates plasma by ionizing propellant (gas) with arc discharge. Lorentz force is generated by current that flows between an anode arranged on the outer circumference side of the thruster and a cathode arranged on the center side, and a magnetic field that is generated by the current (or a previously applied magnetic field). The generated plasma is accelerated with Lorentz force.

As techniques related to the propulsion apparatus used in the space, JP H05-45797B1 (Japanese Patent No. 1,836,674) discloses an electric propulsion machine that obtains thrust force by emitting the plasma generated with the arc discharge from a nozzle. Japanese Patent No. 4,925,132 discloses an ion engine that selectively accelerates charged particles formed through the discharge by using a screen electrode and an acceleration electrode.

SUMMARY OF THE INVENTION

An MPD thruster of the present invention includes an electrodeless plasma generating device configured to generate electrodeless plasma from propellant; an accelerating device configured to accelerate the electrodeless plasma; and a supply passage configured to supply the generated electrodeless plasma to the accelerating device. The accelerating device includes a magnetic coil; a cathode; an anode; and a voltage applying unit configured to apply a voltage between the cathode and the anode. The supply passage supplies the electrodeless plasma to a space between the cathode and the anode. The magnetic coil generates an axial direction magnetic field component along a central axis direction of the magnetic coil and a radial direction magnetic field component orthogonal to the center axis in the space. The voltage applying unit generates a current in the space. The electrodeless plasma supplied to the space is accelerated with Lorentz force induced by the axial direction magnetic field component, the radial direction magnetic field component, and the current.

An electrodeless plasma accelerating method using an MPD thruster according to the present invention is a method of accelerating electrodeless plasma. The electrodeless plasma accelerating method includes supplying electrodeless plasma to a space between a cathode and an anode to down a resistivity in the space; generating an axial direction magnetic field component along a direction of a central axis of the MPD thruster and a radial direction magnetic field component orthogonal to the center axis in the space; generating a current in the space; and accelerating electrodeless plasma with Lorentz force induced by the axial direction magnetic field component, the radial direction magnetic field component and the current.

By the above configuration, the MPD thruster is provided in which supplied power can be restrained, electrode wearing can be educed, and the propulsive efficiency can be improved.

The objects and the advantages of the present invention can be easily confirmed by the following description and the attached drawings.

BRIEF DESCRIPTION OF THE DRAWINGS

The attached drawings are incorporated into the Specification to assist the description of embodiments. The drawings should not be interpreted to limit the present invention to illustrated examples and described examples.

DESCRIPTION OF THE EMBODIMENTS

Hereinafter, an MPD thruster according to the embodiments of the present invention will be described with reference to the attached drawings.

In the following detailed description, many detailed specific items are disclosed for the purpose of description to provide the comprehensive understanding of the embodiments. However, it would be apparent that the plurality of embodiments can be carried out without these detailed specific items. Also, regarding to a well-known configuration or a well-known apparatus, only an overview is shown to simplify the drawings.

(Definition of Coordinate System)

Figure 1:
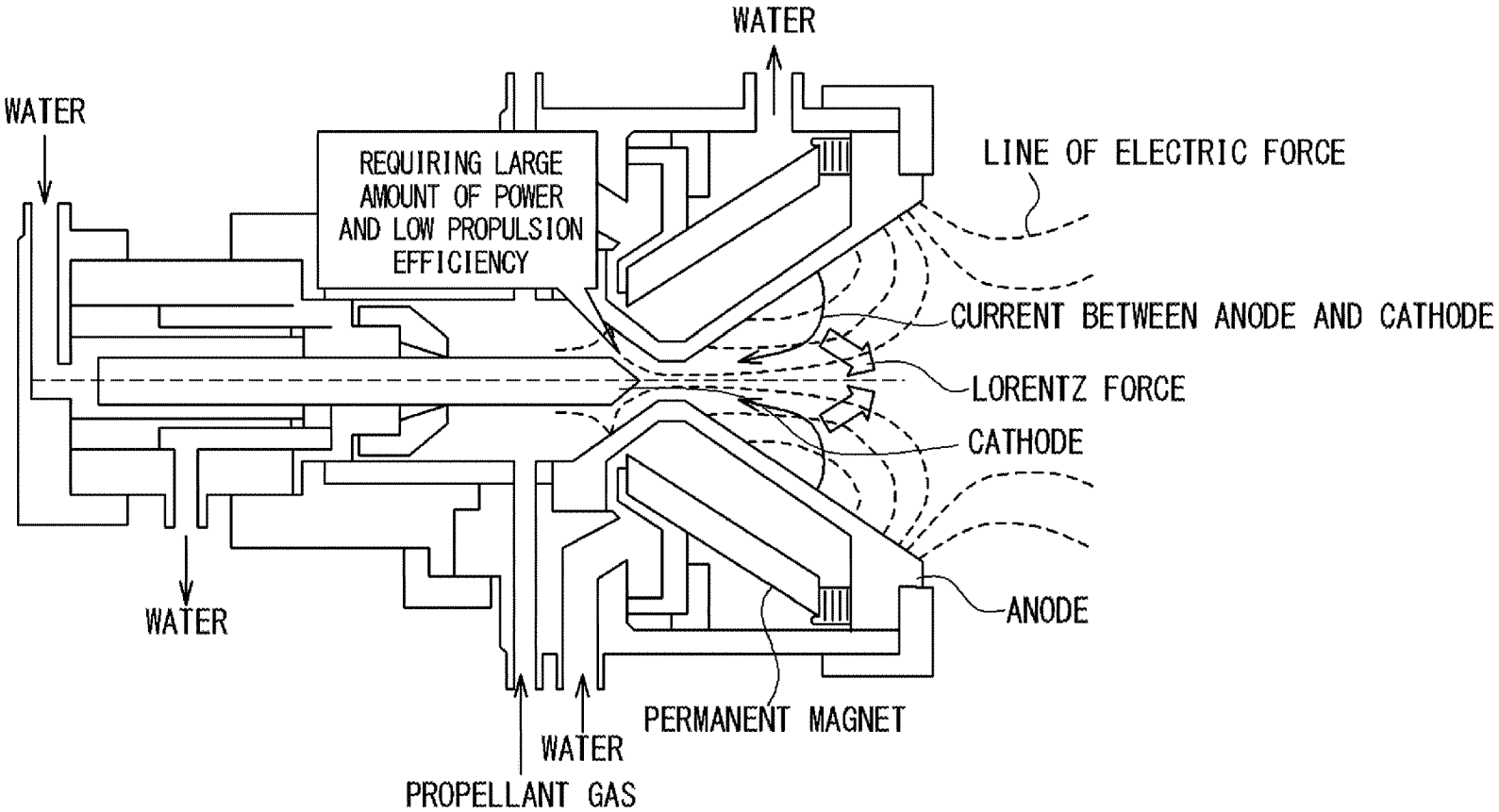
Fig. 1 PRIOR ART
FIG. 1 is a sectional view schematically showing the configuration of a conventional MPD thruster.
Figure 2A:
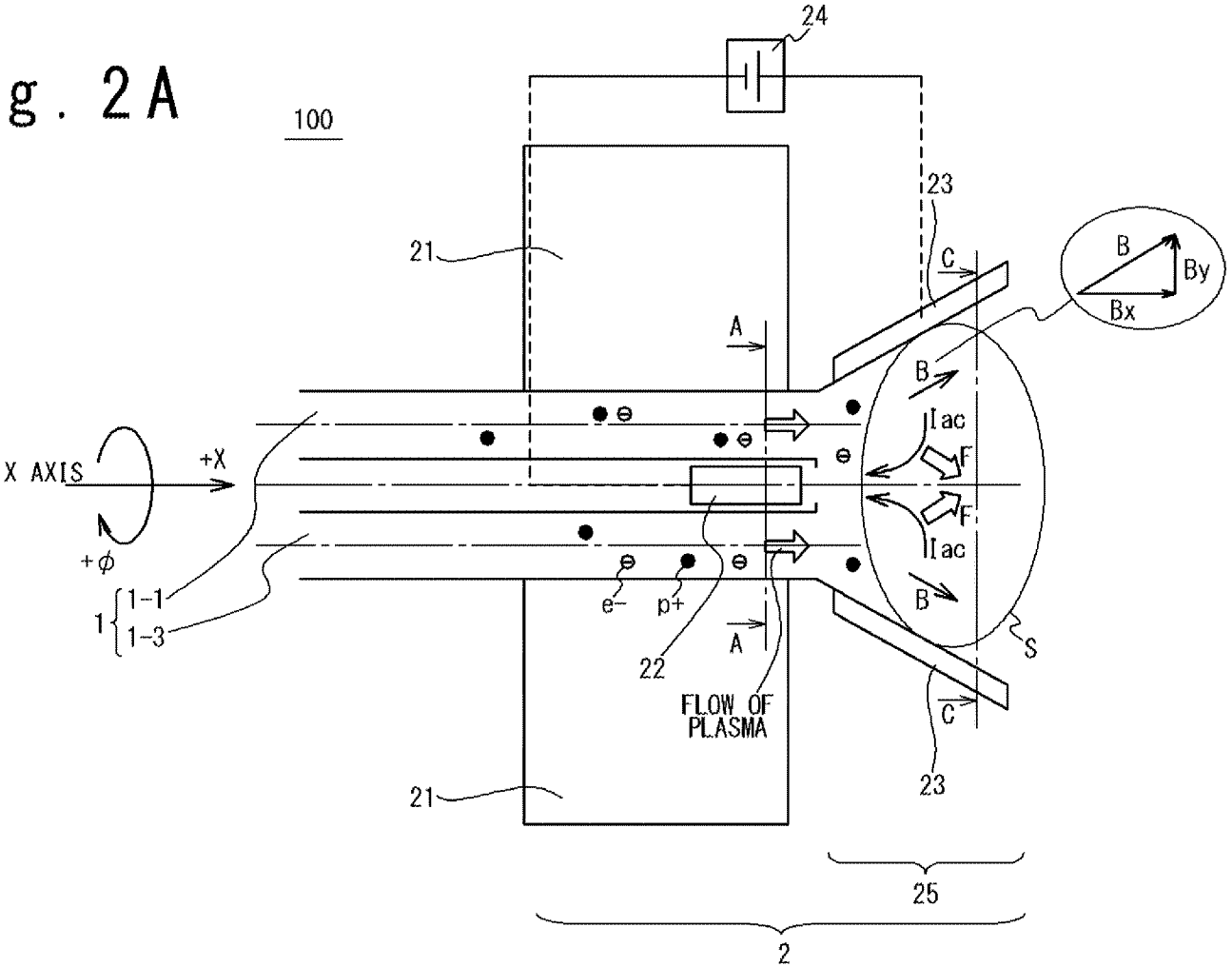
FIG. 2A is a sectional view schematically showing the configuration of an MPD thruster according to a first embodiment of the present invention.
Figure 3A:
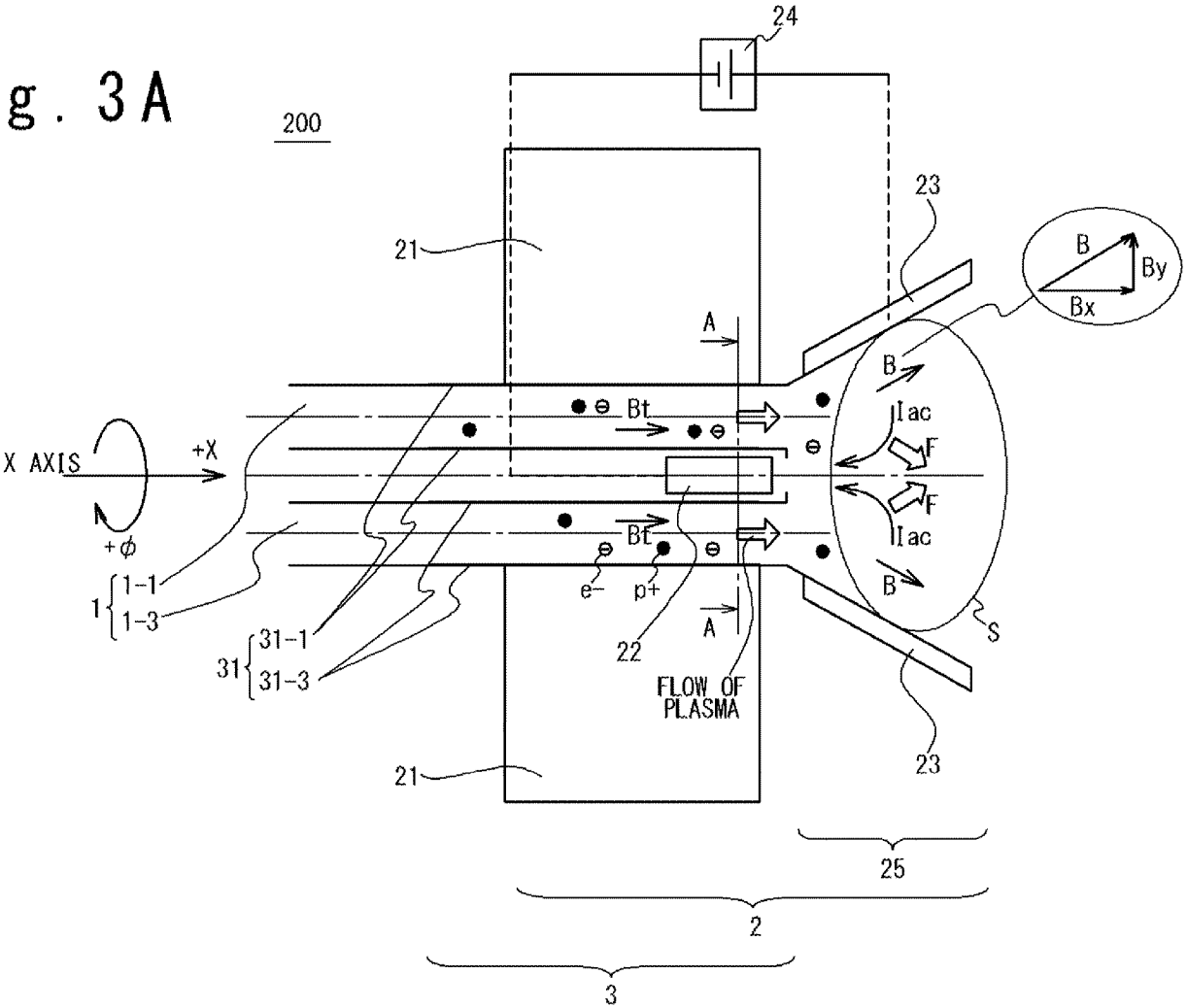
FIG. 3A is a sectional view schematically showing the configuration of the MPD thruster according to a second embodiment of the present invention.

With reference to FIG. 2A and FIG. 3A, the coordinate system is defined. An X direction is a forward or rear direction in MPD thruster 100 and 200. A +X direction means a rear direction of the MPD thrusters 100 and 200, i.e. a direction on a nozzle. A ϕ direction is a turn direction around the X axis which is a central axis of the MPD thrusters 100 and 200. A +ϕ direction means a clockwise direction in viewing in the +X direction.

(Definition of Important Terms)

In the present embodiment, a side in the +X direction is a defined as a "downstream side", and a side in a −X direction is defined as an "upstream side". Also, an "electrodeless plasma" is defined as plasma generated by an electrodeless plasma generating device. The "electrodeless plasma generating device" is defined as a plasma generating device in which an electrode and the plasma do not contact directly in a plasma generation process.

[First Embodiment]

Figure 2B:
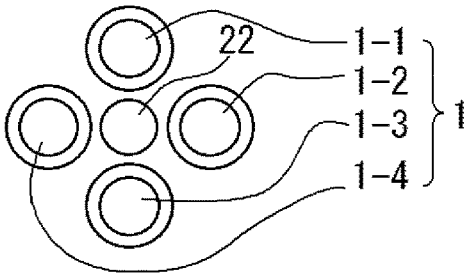
FIG. 2B is a sectional view along the A-A line in FIG. 2A.
Figure 2C:
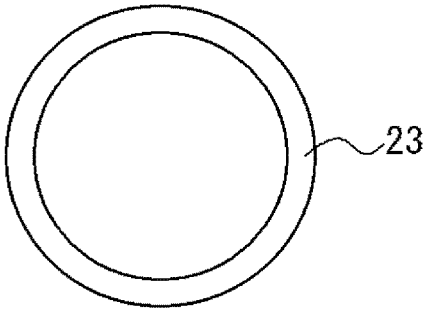
FIG. 2C is a sectional view along the C-C line in FIG. 2A.

Referring to FIG. 2A to FIG. 2C, the MPD thruster according to a first embodiment will be described. FIG. 2A is a sectional view schematically showing the configuration of the MPD thruster 100 of the first embodiment. Also, FIG. 2B and FIG. 2C are a sectional view along the A-A line in FIG. 2A and a sectional view along the C-C line in FIG. 2A, respectively.

1. Configuration of MPD Thruster 100

The MPD thruster 100 has a supply passage 1 which supplies electrodeless plasma, an accelerating device 2 and an electrodeless plasma generating device (not shown).

(Supply Passage 1)

For example, the supply passage 1 is configured from four supply pipes 1-1, 1-2, 1-3, and 1-4. Note that the number of supply pipes is not limited to four and is optional. Also, the inner diameter of the supply pipe may be equal to or more than 20 mm and equal to or less than 100 mm. Also, when a plurality of supply pipes are arranged, it is desirable to arrange the supply pipes in an equal interval around a cathode 22 to be described later. Note that the cathode 22 and the supply pipe may be separated to an extent that they never contact. A propellant is supplied into the supply passage 1. For example, the propellant is such as argon gas and xenon gas. The propellant supplied to the supply passage 1 is ionized to positive ions $P^+$ and electrons $e^-$ (converted into plasma) by an electrodeless plasma generating device, so as to generate electrodeless plasma. Note that the electrodeless plasma generating device may be whatever apparatus if it can generate the electrodeless plasma. Alternatively, the electrodeless plasma previously generated by the electrodeless plasma generating device may be supplied to the supply passage 1. The electrodeless plasma in the supply passage 1 is supplied to the accelerating device 2. In more detailed, the electrodeless plasma is supplied to a space S between the cathode 22 and an anode 23.

(Accelerating Device 2)

The accelerating device 2 has a magnetic coil 21, the cathode 22, the anode 23, and a voltage applying unit 24. The magnetic coil 21 is disposed to surround the supply passage 1. In other words, the supply passage 1 crosses the central region of magnetic coil 21. Here, the central region of the magnetic coil 21 means a cavity region inside the inner diameter of the magnetic coil 21. It is desirable that the central axis of the magnetic coil 21 coincides with the X axis. The magnetic coil 21 generates a magnetic field B in the space S between the cathode 22 and the anode 23. The magnetic field B has an axial direction magnetic field component Bx as a component along the central axis (the X axis) of the magnetic coil 21 and a radial direction magnetic field component By as a component orthogonal to the central axis (the X axis). The cathode 22 emits electrons. The cathode 22 is desirably a hollow cathode with fine holes. The anode 23 is arranged on the downstream side of the cathode. The anode 23 is desirably configured from a plate configuring at least a part of the inner surface of the nozzle 25. Note that the anode 23 may be configured from a combination of division bodies as a plurality of parts. Also, it is desirable that the nozzle 25 has an inclination inner surface spreading into a downstream direction. The voltage applying unit 24 applies a voltage between the cathode 22 and the anode 23, to generate a current Iac between the cathode 22 and the anode 23, namely, in a space S. Note that in FIG. 2A, a wiring connecting the voltage applying unit 24 and the cathode 22 and a wiring connecting the voltage applying unit 24 and the anode 23 are shown to make it easy to understand, for descriptive purposes. The actual wirings are not limited to an example of FIG. 2A and may be appropriately designed. The current Iac is a discharge current when the hollow cathode is not used. The current Iac is a current which is based on a flow of thermal electrons emitted from the hollow cathode when the hollow cathode is used. The accelerating device 2 accelerates the electrodeless plasma supplied through the supply passage 1 toward the downstream direction with Lorentz force which is induced by the magnetic field B and the current Iac.

A case that the cathode of the accelerating device 2 is the hollow cathode will be described in detail. The hollow cathode has an insert of chemical substance. When the insert is heated by a heater, the insert emits thermal electrons. The emitted thermal electrons collide with an operation gas supplied into the hollow cathode to generate plasma in the hollow cathode. When the positive electrode is disposed in the exit of the cathode, electrons are emitted from the plasma to the outside of the cathode. The insertion is heated by the heater before the cathode operates, but when the cathode operates once, the electrons can be emitted with heat outputted from the plasma.

2. Operation Principle of MPD Thruster 100

Next, the operation principle of the MPD thruster 100 will be described.

(1) The electrodeless plasma (positive ions $P^+$ and electrons $e^-$) is supplied from the supply passage 1 into the space S between the cathode 22 and the anode 23. The resistivity in the space S between the cathode 22 and the anode 23 decreases or downs.

(2) By operating the magnetic coil 21, the magnetic field B which contains the axial direction magnetic field component Bx and the radial direction magnetic field component By is generated in the space S.

(3) A voltage and a power are applied between the cathode 22 and the anode 23 so that the current Iac flows through the space S. The current Iac may be a discharge current between the cathode 22 and the anode 23 or may be the current which is based on the flow of thermal electrons emitted from the hollow cathode. Because the resistivity in the space S can be decreased, the voltage and power to be applied can be made smaller, compared with the conventional MPD thruster. Note that a start order of the above (1), (2) and (3) processes is optional. Also, the above (1), (2) and (3) processes may be started at a same time.

(4) A part of the electrons $e^{31}$ in the space S (the electrons emitted from the cathode 22 and the electrons contained in the electrodeless plasma) is captured by the anode 23 (to form the current Iac). Also, a part of the electrons $e^-$ in the space S is accelerated toward the downstream direction with Lorentz force and emitted from the nozzle 25 toward the downstream direction. Note that the overview of an acceleration mechanism with the Lorentz force is as the following (4a) and (4b).

(4a) The electrons e– turns to the +ϕ direction around the central axis of the magnetic coil 21 (the X axis) with the Lorentz force induced by a radial direction component of the current Iac (a component toward the X axis) and the axial direction magnetic field component Bx.

(4b) The current in the −ϕ direction flows by the turning. The electrons $e^-$ are accelerated to the +X direction with the Lorentz force induced by the current in the −ϕ direction of and the radial direction magnetic field component By. Note that the above (4a) and (4b) are actually a phenomenon which they concurrently progress.

(5) The electrons e accelerated to the +X direction, i.e. toward the downstream direction attract the positive ions $P^+$ with the coulomb force, and make the positive ions $P^+$ accelerate toward the downstream direction. Then, the positive ions $P^+$ are emitted from the nozzle 25 for the downstream direction. The MPD thruster 100 can acquire thrust force through the reaction which accompanies the emission.

(6) Note that an electric field inclination exists between the anode 23 and the electrons $e^-$ emitted from the nozzle 25. Therefore, the positive ions $P^+$ are accelerated to the downstream direction due to the electric field inclination.

The electrodeless plasma supplied from the supply passage 1 is plasma generated without direct contact of the electrode and the plasma in the plasma generation process. Such electrodeless plasma is generally accelerated by using the accelerating device in which the electrode and the plasma do not contact. On the other hand, in the present embodiment, the electrodeless plasma is accelerated by the accelerating device 2 having the electrodes (the anode and the cathode) which contact the plasma.

3. Effect

In this embodiment, the electrodeless plasma is supplied to the space S to decrease the resistivity of the space S. Therefore, it is possible that the voltage and power to be applied between the cathode and the anode can be made smaller, compared with the conventional MPD thruster. As a result, the operation efficiency of the MPD thruster improves. Also, by making the power small, a temperature rise of the MPD thruster can be restrained. As the result, the MPD thruster can be operated for a longer period.

When the hollow cathode is used as the cathode of the present embodiment, the following effect is attained. At first, because a wear amount of the cathode due to a discharge is restrained, a lifetime of the electrode can be made long. At second, it is possible to control the intensity of the above-mentioned Lorentz force by controlling a quantity of thermal electrons emitted from the hollow cathode.

In the present embodiment, the electrodeless plasma is used. A positive ion density of the electrodeless plasma as much as or more than a positive ion density of plasma generated through an arc discharge can be obtained. In addition, a high density region can be formed over the almost whole discharge region in the foregoing case, whereas a high density region can be obtained only in an extremely limited region called positive column in the latter case. For this reason, it is possible to increase a rate of the positive ions to about 100 times more than that on the arc discharge, and as a result, it is possible to make the thrust force of the MPD thruster large.

In the present embodiment, the electrodeless plasma is supplied from the supply passage 1. Therefore, a process of converting the propellant to the plasma by using the arc discharge or the thermal electrons in the accelerating device is not required. As a result, the propulsive efficiency of the MPD thruster improves.

Also, according to the MPD thruster in the embodiment, the following problems can be overcome.

(Problem of Power or Heat)

The MPD thruster sometimes uses the arc discharge for the plasma generation. To make the arc discharge generate, the large power becomes necessary. Also, because the large power is applied, it is easy for a temperature of the thruster to become hot. Therefore, it is sometimes difficult that the MPD thruster realizes a regular operation. Accordingly, the MPD thruster sometimes has a low propulsive efficiency and it is difficult to apply the MPD thruster to a space machine which has the restraint in a power supply quantity and a heat discharge quantity.

(Problem of Electrode Wear Amount)

In the MPD thruster, the arc discharge sometimes wears out the cathode of the thruster. Therefore, it is difficult to make an operation lifetime long. It could be considered to use the hollow cathode as the cathode, to make the operation lifetime long. However, when the hollow cathode is used, a problem about the propulsive efficiency exists sometimes.

(Problem of Propulsive Efficiency)

It could be considered to increase a density of the positive ions having a large mass compared with an electron, in order to obtain the thrust force efficiently. However, a small amount of the positive ions is sometimes outputted from the above hollow cathode. Therefore, it could be considered to increase the density of positive ions by making the thermal electrons emitted from the hollow cathode collide with propellant gas. However, it is not efficient to generate the thermal electrons and to make them collide with propellant gas. Even when the hollow cathode is used, there is a case that it is difficult to improve the propulsive efficiency.

[Second Embodiment]

Referring to FIG. 3A to FIG. 6, the plasma accelerating device according to a second embodiment will be described.

In the second embodiment, the same reference numerals are assigned to the same components as in the first embodiment.

1. Configuration of MPD Thruster 200

An MPD thruster 200 has the supply passage 1 which supplies the electrodeless plasma, the accelerating device 2 and the electrodeless plasma generating device 3.

(Electrodeless Plasma Generating Device 3)

Figure 3B:
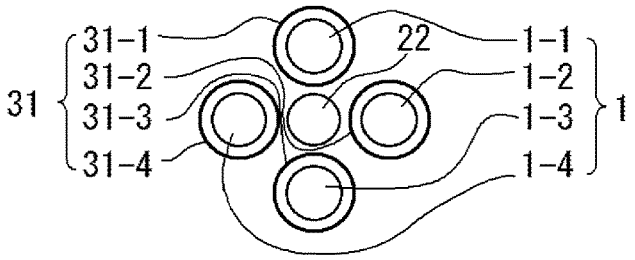
FIG. 3B is a sectional view along the A-A line in FIG. 3A.
Figure 4:
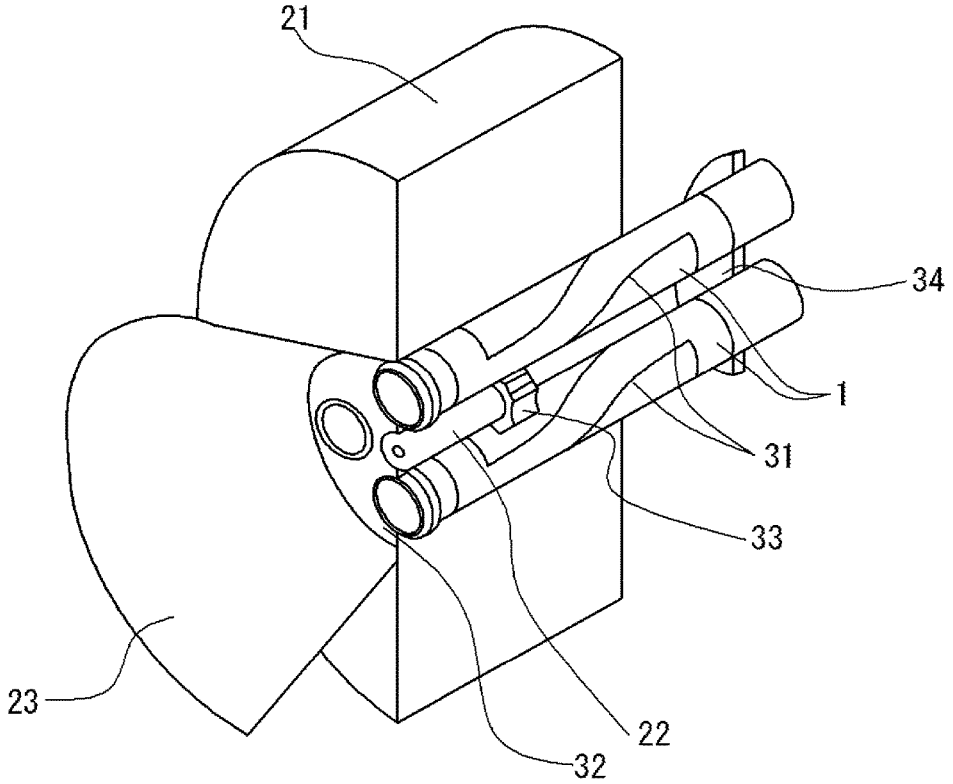
FIG. 4 is a perspective view of the MPD thruster of the second embodiment, in which a part of the thruster is cut off.
Figure 5A:
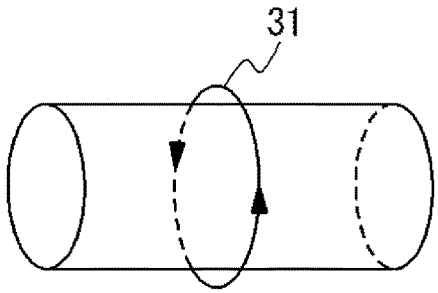
FIG. 5A is a diagram showing a first example of antenna (a plasma generation antenna).
Figure 5B:
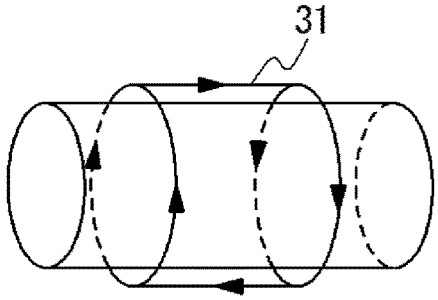
FIG. 5B is a diagram showing a second example of antenna (the plasma generation antenna).
Figure 5C:
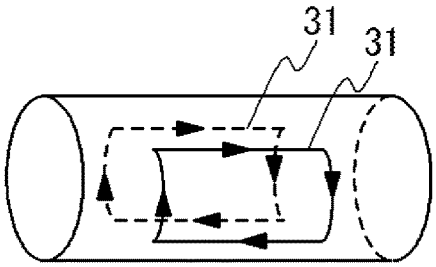
FIG. 5C is a diagram showing a third example of antenna (the plasma generation antenna).
Figure 5D:
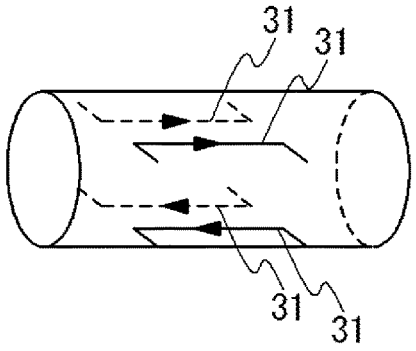
FIG. 5D is a diagram showing a fourth example of antenna (the plasma generation antenna).
Figure 5E:
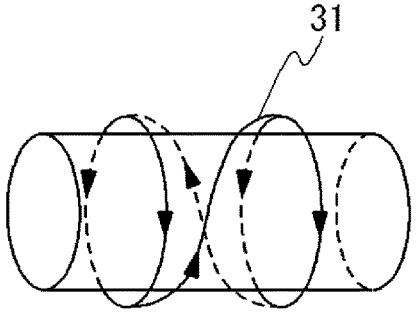
FIG. 5E is a diagram showing a fifth example of antenna (the plasma generation antenna).
Figure 5F:
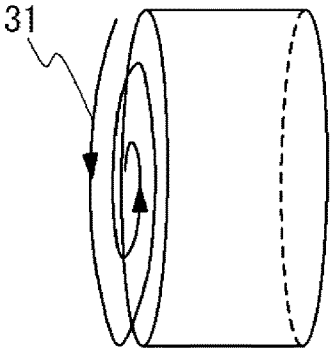
FIG. 5F is a diagram showing a sixth example of antenna (the plasma generation antenna).
Figure 6:
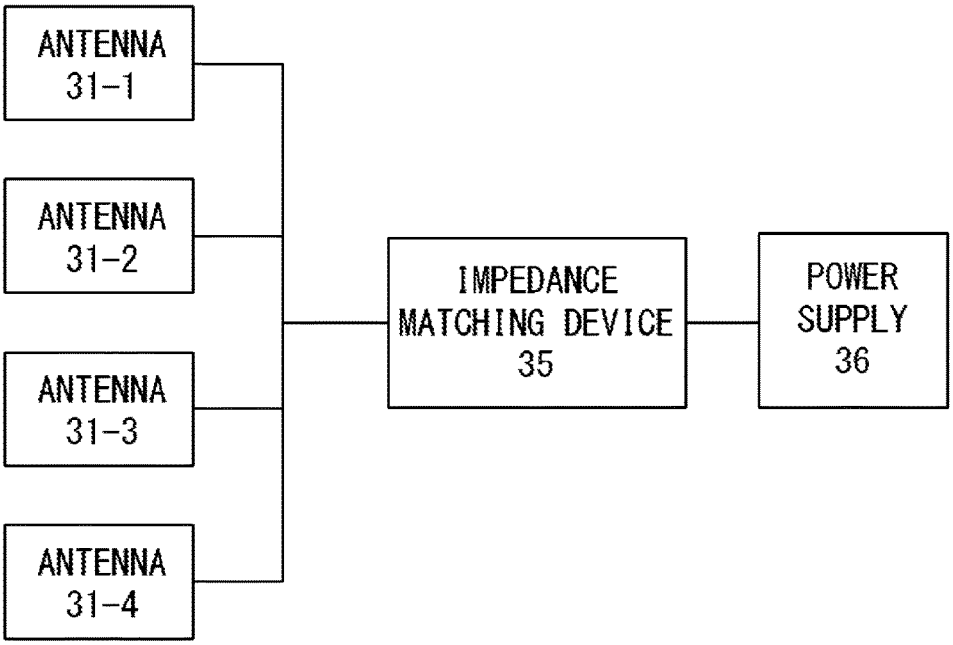
FIG. 6 is a functional block diagram showing an example of a driver of the antenna in the second embodiment of the present invention.

Referring to FIG. 3A to FIG. 6, the electrodeless plasma generating device 3 will be described. FIG. 3A is a sectional view schematically showing the configuration of the MPD thruster 200 of the second embodiment. FIG. 3B is a sectional view of the line A-A in FIG. 3A. FIG. 4 is a perspective view of the MPD thruster 200 according to the second embodiment, in which a part of the thruster is cut out. Also, FIG. 5A to FIG. 5F are diagrams showing first to sixth examples of antenna (plasma generation antenna). FIG. 6 is a functional block diagram showing an example of a driver of the antenna.

The electrodeless plasma generating device 3 contains the magnetic coil 21 and the antenna 31. The magnetic coil 21 is a component of the accelerating device 2 and is a component of the electrodeless plasma generating device 3. It is desirable that the antenna 31 contains a plurality of antennas 31-1, 31-2, 31-3, and 31-4. The plurality of antennas 31-1, 31-2, 31-3, and 31-4 are respectively arranged around a plurality of supply pipes 1-1, 1-2, 1-3, and 1-4. Also, the magnetic coil 21 is arranged to surround the supply pipes 1-1, 1-2, 1-3, and 1-4 and the antennas 31-1, 31-2, 31-3, and 31-4. In other words, the supply pipes 1-1, 1-2, 1-3, and 1-4 around which the antennas are arranged cross the central region of the magnetic coil 21. Note that the four supply pipes and the four antennas are shown in FIG. 3B. However, the number of supply pipes and the number of antennas are not limited to four and are optional. As shown in FIG. 4, the supply passage 1 (or the supply pipes) around which the antennas 31 are arranged is supported with support mechanisms 32, 33, and 34. The support mechanism 32 is a downstream side support mechanism, the support mechanism 33 is a central support mechanism, and the support mechanism 34 is an upstream side support mechanism. Each of the support mechanisms 32, 33, and 34 has a function as a spacer to support and separate the supply passage 1 (or each supply pipe) from the cathode 22.

The antenna 31 is a high frequency antenna. A helicon wave is generated by interaction of an electric field induced by the high frequency antenna and the axial direction magnetic field Bt generated by the magnetic coil 21 (referring to FIG. 3A). The helicon wave acts on the propellant which is supplied to the supply passage 1 to convert the propellant to plasma. As a result, the helicon plasma which is electrodeless plasma is generated. Because a high density of helicon plasma can be generated, it is desirable to adopt the helicon plasma as the electrodeless plasma.

As the antenna 31, the antennas of various forms can be adopted. FIG. 5A shows a first example of the antenna. The antenna of the first example is a loop antenna. FIG. 5B shows a second example of antenna. The antenna of the second example is Boswell antenna. FIG. 5C shows a third example of antenna. The antenna of the third example is a saddle-type antenna. FIG. 5D shows a fourth example of antenna. The antenna of the fourth example is a Nagoya-type 3-type antenna. In this antenna, it is possible to select any of a plurality of modes by changing phases among four coil currents. FIG. 5E shows a fifth example of antenna. The antenna of the fifth example is a helical antenna. FIG. 5F shows a sixth example of antenna. The antenna of the sixth example is a spiral-type antenna. It is possible to apply the antenna to the plasma supply passage with a large diameter.

As shown in FIG. 6, the driver of the antenna may include antennas 31-1, 31-2, 31-3, and 31-4, an impedance matching device 35, a power supply 36. The impedance matching device 35 functions to match an input impedance of the power supply 36 to a load impedance of the antennas 31-1, 31-2, 31-3, and 31-4. In the present embodiment, one power supply 36 drives the plurality of antennas 31-1, 31-2, 31-3, and 31-4 through the impedance matching device 35. Note that it is desirable that the power supply 36 is one but is not limited to one.

2. Operation Principle of MPD Thruster 200

Next, the operation principle of the MPD thruster 200 will be described. The operation principle of the MPD thruster 200 in the present embodiment is different from that of the MPD thruster 100 in the first embodiment in that it is specified to use the magnetic coil 21 and the antenna 31 for the generation of the electrodeless plasma.

(1) The propellant is supplied to the supply passage 1.
(2) Through the interaction of the electric field induced by antenna 31 and the axial direction magnetic field Bt generated by the magnetic coil 21, the electrodeless plasma is generated.
(3) The generated electrodeless plasma is supplied to the space S between the cathode 22 and the anode 23 through the supply passage 1. The operation principle after the electrodeless plasma is supplied to the space S is the same as the operation principle of the first embodiment.

3. Effect

In this embodiment, the electrodeless plasma is generated by using the magnetic coil 21 of the accelerating device 2. That is, a magnetic field for the acceleration and a magnetic field for the generation of the electrodeless plasma are generated by using the identical magnetic coil 21. Therefore, the weight of the MPD thruster can be reduced. Also, the power which becomes necessary for the magnetic coil to operate can be reduced. As a result, the propulsive efficiency of the MPD thruster improves.

In this embodiment, when generating the helicon plasma, a density of the positive ions can be made higher. As a result, it is possible to make the thrust force of the MPD thruster large.

In the present embodiment, when a plurality of antennas are driven with a single power supply, the weight of the thruster can be reduced.

(Position Relation of Supply Passage 1, Cathode 22, and Anode 23)

Figure 7:
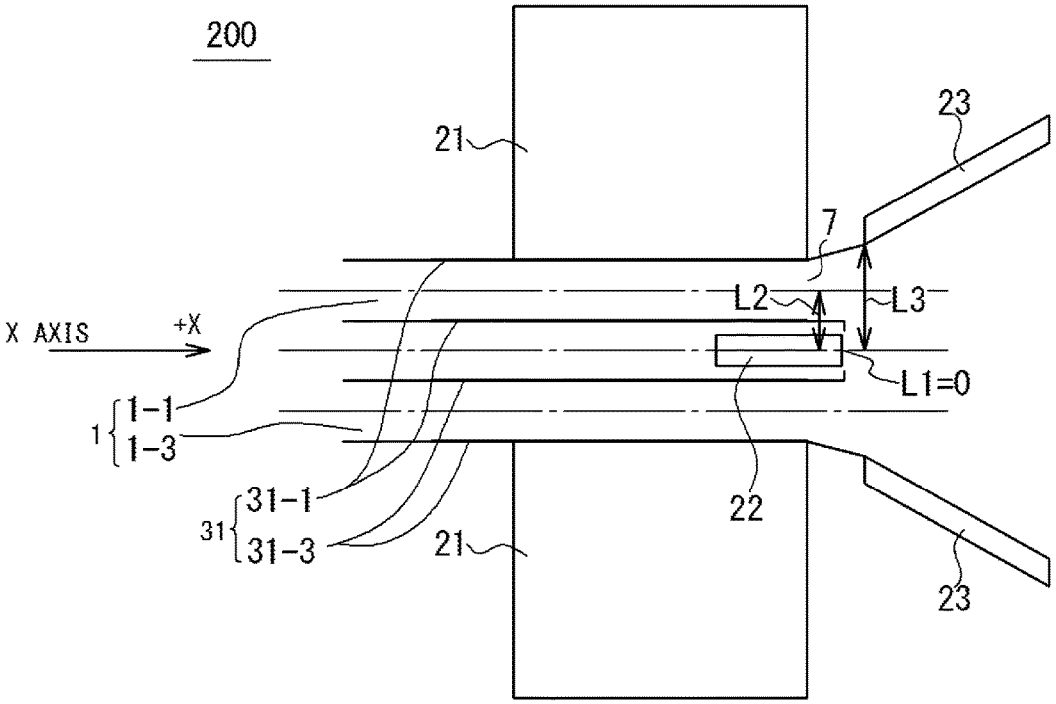
FIG. 7 is a diagram schematically showing a position relation of a supply passage, a cathode, and an anode, and a position relation of the supply passage, the antenna, and a magnetic coil in the embodiment of the present invention.

Referring to FIG. 7, a specific instance of the position relation of the supply passage 1, the cathode 22, and the anode 23 in the embodiments of the present invention will be described. It is desirable that the position of an exit 7 of the supply passage 1 is on the upstream side of the position of the anode 23. Also, it is desirable that the position of the cathode 22 is on the upstream side of the position of the anode 23. It is desirable that a distance L2 between the supply passage 1 (a center of each of the supply pipes) and the central axis (X axis) of the magnetic coil 21 is larger than a distance L1 between the cathode 22 (the center of the cathode 22) and the central axis (X axis) of the magnetic coil 21. Note that the distance L1 between the cathode 22 (the center of the cathode 22) and the central axis (X axis) of the magnetic coil 21 is zero and it is desirable that the cathode 22 is arranged along the center axis. Also, it is desirable that the distance L2 between the supply passage 1 (the center of each supply pipes) and the central axis (X axis) of the magnetic coil 21 is smaller than a distance L3 between the anode 23 (a part of the anode 23 which is the nearest to the central axis of the coil) and the central axis (X axis) of the magnetic coil 21.

By adopting the above-mentioned position relation, the axial direction magnetic field component Bx along the direction of the central axis of the magnetic coil 21 and the radial direction magnetic field component By orthogonal to the center axis are generated suitably. Also, the apparatus configuration of the MPD thruster can be made compact.

(Position Relation of Supply Passage 1, Antenna 31, and Magnetic Coil 21)

Next, referring to FIG. 7, when the antenna 31 is arranged around the supply passage 1, a specific instance of the position relation of the supply passage 1, the antenna 31, and the magnetic coil 21 will be described. It is desirable that the antenna 31 and the magnetic coil 21 are arranged so that at least a part of each of the antenna 31 and the magnetic coil 21 overlaps in the center axial direction (the direction of X axis) of the magnetic coil 21. For example, the antenna 31 and the magnetic coil 21 are arranged to overlap in a direction of the central axial of the magnetic coil 21.

By adopting the above-mentioned position relation, the axial direction magnetic field component Bx is generated inside the supply passage 1 corresponding to the position of the antenna 31, and as the result, the generation efficiency of the electrodeless plasma improves.

(Modification Example in Supply Passage 1)

Figure 8:
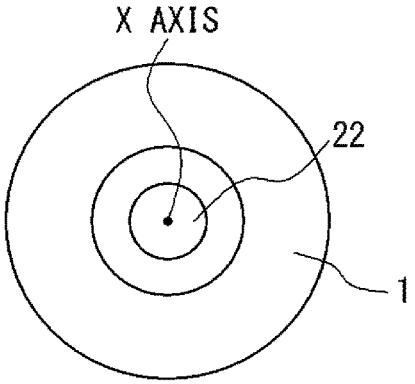
FIG. 8 is a sectional view showing a modification example of the supply passage in the embodiments of the present invention and is the sectional view orthogonal to the X axis.

FIG. 8 is a sectional view showing a modification example of the supply passage 1 and is the section which is perpendicular to the X axis. As shown in FIG. 8, the supply passage having a ring sectional shape may be arranged as the supply passage 1 of the electrodeless plasma, instead of arranging a plurality of supply passages (pipes) around the cathode 22.

The present invention is not limited to the above embodiments. It would be apparent that the embodiments may be changed or modified appropriately in a range of technical thought of the present invention. Also, various techniques used in one embodiment may be applied to another embodiment, as long as any technical contradiction is not caused.

The invention claimed is:

1. An MPD thruster comprising:

an electrodeless plasma generating device configured to generate electrodeless plasma from propellant;

an accelerating device configured to accelerate the electrodeless plasma; and a supply passage configured to supply the electrodeless plasma which has been generated to the accelerating device, wherein the accelerating device comprises:

a magnetic coil;

a cathode;

an anode;

a nozzle configured to emit the electrodeless plasma which has been accelerated; and a voltage applying unit configured to apply a voltage between the cathode and the anode, wherein the supply passage supplies the electrodeless plasma to a space between the cathode and the anode, wherein the magnetic coil generates an axial direction magnetic field component along a direction of a center axis of the MPD thruster and a radial direction magnetic field component orthogonal to the center axis of the MPD thruster in the space, the space being positioned downstream of the supply passage, wherein the voltage applying unit generates a current in the space, wherein the electrodeless plasma supplied to the space is accelerated with Lorentz force induced by the axial direction magnetic field component, the radial direction magnetic field component, and the current, wherein the anode constitutes at least a part of an inner surface of the nozzle, wherein an entirety of the anode is positioned downstream of the magnetic coil, and wherein the supply passage includes a plurality of supply pipes arranged around the cathode.

2. The MPD thruster according to claim 1, wherein a distance between the supply passage and the center axis of the MPD thruster is larger than a distance between the cathode and the center axis of the MPD thruster and is smaller than a distance between the anode and the center axis of the MPD thruster.

3. The MPD thruster according to claim 1, wherein the cathode is arranged along the center axis of the MPD thruster.

4. The MPD thruster according to claim 1, wherein the electrodeless plasma generating device comprises an antenna arranged around the supply passage, and wherein the electrodeless plasma generating device converts the propellant to the electrodeless plasma through interaction of an electric field induced by the antenna and the magnetic field generated by the magnetic coil.

5. The MPD thruster according to claim 4, wherein the supply pipes are arranged at equal intervals around the cathode, wherein the antenna is one of a plurality of antennas, and wherein a corresponding one of the plurality of antennas is arranged around each of the plurality of supply pipes.

6. The MPD thruster according to claim 5, wherein the electrodeless plasma generating device further comprises:

one power supply; and an impedance matching device, wherein the power supply is configured to drive the plurality of antennas through the impedance matching device.

7. The MPD thruster according to claim 4, wherein the antenna is a helical antenna and the electrodeless plasma is helicon plasma.

8. The MPD thruster according to claim 1, wherein the cathode is a hollow cathode.

9. An electrodeless plasma accelerating method using an MPD thruster, comprising:

by using a supply passage, supplying electrodeless plasma to a space between a cathode and an anode to reduce a resistivity in the space, the space being positioned downstream of the supply passage;

by using a magnetic coil, generating an axial direction magnetic field component along a direction of a center axis of the MPD thruster and a radial direction magnetic field component orthogonal to the center axis of the MPD thruster in the space;

generating a current in the space;

accelerating electrodeless plasma with Lorentz force induced by the axial direction magnetic field component, the radial direction magnetic field component and the current; and emitting the electrodeless plasma which has been accelerated from a nozzle, wherein the anode constitutes at least a part of an inner surface of the nozzle, wherein an entirety of the anode is positioned downstream of the magnetic coil, and wherein the supply passage includes a plurality of supply pipes arranged around the cathode.

10. The MPD thruster according to claim 1, wherein the supply pipes are positioned at equal intervals around the cathode.

11. The MPD thruster according to claim 1, wherein the supply pipes are positioned so as to be spaced from the cathode.

12. The MPD thruster according to claim 5, wherein the magnetic coil is positioned to at least partially overlap the plurality of antennas in the direction of the center axis of the MPD thruster.

13. The method according to claim 9, wherein the supply pipes are positioned at equal intervals around the cathode.

14. The method according to claim 9, wherein the supply pipes are positioned so as to be spaced from the cathode.

15. The method according to claim 9, wherein the magnetic coil is positioned to at least partially overlap the plurality of antennas in the direction of the center axis of the MPD thruster.

* * * * *